United States Patent [19]

Shindo

[11] Patent Number: 4,781,492

[45] Date of Patent: Nov. 1, 1988

[54] BLOCK FOR REVETMENT

[75] Inventor: Kunio Shindo, Sapporo, Japan

[73] Assignee: Kyowa Concrete Kogyo Co. Ltd., Sapporo, Japan

[21] Appl. No.: 37,586

[22] Filed: Apr. 10, 1987

[30] Foreign Application Priority Data

May 17, 1986 [JP] Japan ..... 61-74129

[51] Int. Cl.[4] ..... E02B 3/12

[52] U.S. Cl. ..... 405/16; 52/606; 404/41; 405/20

[58] Field of Search ..... 405/16, 17, 20, 25, 405/29; 52/596, 603–606, 608; 404/34, 40, 41

[56] References Cited

U.S. PATENT DOCUMENTS

| | | | |
|---|---|---|---|
| 1,939,417 | 12/1933 | Schulz | 405/20 |
| 3,176,468 | 4/1965 | Nagai et al. | 405/29 |
| 4,227,829 | 10/1980 | Landry | 405/20 |
| 4,269,537 | 5/1981 | O'Neill | 405/29 |
| 4,370,075 | 1/1983 | Scales | 405/20 |

FOREIGN PATENT DOCUMENTS

| | | | |
|---|---|---|---|
| 2139676 | 11/1984 | United Kingdom | 405/20 |

*Primary Examiner*—David H. Corbin

*Attorney, Agent, or Firm*—Stevens, Davis, Miller & Mosher

[57] ABSTRACT

A block for a revetment is disclosed. It comprises a square-shaped block member having a slant under-surface, leg members having the same height and provided at four corner portions of the slant under-surface of the block member, a through hole formed at a central portion of an upper-surface of the block member all the way down to the under-surface thereof, a concave groove having a generally half dimension as that of the through hole and formed on both left and right side portions of the block member, a recess formed on both front and rear surface portions at locations spaced apart by ¼ of the length of the block member from the left and right sides respectively and an iron reinforcing bar buried in the block member and projecting within the recess.

2 Claims, 3 Drawing Sheets

BLOCK FOR REVETMENT

BACKGROUND OF THE INVENTION

This invention relates to an improvement on a block to be used for a revetment, in which a plurality of such blocks are connected one another and laid in tiers on the slopes of seashores and rivers so that safety for walking thereon is enhanced.

Methods for laying the blocks on the slopes of seashores and the like are known. One conventional method is that square-shaped blocks having the generally same thickness are used and mortar is filled in the jointing portions formed between adjacent blocks laid. Another conventional method is that each block is provided with two or more through holes formed thereon in parallel relation, and such blocks are laid in parallel relation and connected one another by inserting an iron wire into each of the through holes intercommunicated.

The first-mentioned method in which mortar is filled in the jointing portions has the shortcoming in that the blocks laid are separated apart due to sinking of the ground and the like and the blocks are disconnected one another to permit the ground to be exposed therefrom. Thus, the blocks lose their own function. On the other hand, the second-mentioned method in which an iron wire is inserted into the through holes has the shortcoming in that the blocks laid are displaced one-sidedly due to the change of the ground and the blocks are separated apart one another and the ballasts thereunder are sucked out to form a hollow ground, thus disabling to construct a strong revetment.

The present invention was accomplished in order to solve the above-mentioned problems inherent in the prior art.

SUMMARY OF THE INVENTION

It is therefore a general object of the present invention to provide an improvement on a block for a revetment in which iron reinforcing bars are buried in each of blocks at the upper tier side and in each of blocks at the lower tier side and when the blocks are connected and laid, the iron reinforcing bars are connected to obtain a firm connection. In this way, the blocks are laid in tiers, so that safety of walking thereon is enhanced.

In order to achieve the above object, there is essentially provided a block for a revetment comprising a square-shaped block member having a slanted under-surface extending from the front surface to the rear surface, leg members having the same height and extending downwardly from the four corners of the slant under-surface of the block member, through hole means formed at a central portion of an upper-surface of the block member all the way down to the under-surface thereof, concave groove means having a generally half dimension as that of the through hole and formed on both left and right surface portions of the block member, recess means formed on both front and rear surface portions at locations spaced apart by $\frac{1}{4}$ of the length of the block member from the left and right sides respectively and an iron reinforcing bar buried in the block member and projecting within the recess means.

BRIEF DESCRIPTION OF THE DRAWINGS

For a better understanding of the present invention, together with other and further objects thereof, reference is made to the following detailed description of the embodiment, taken in connection with the accompanying drawings, wherein.

DETAILED DESCRIPTION OF THE EMBODIMENT

One preferred embodiment of the present invention will be described hereinafter with reference to the accompanying drawings.

Figure 1:
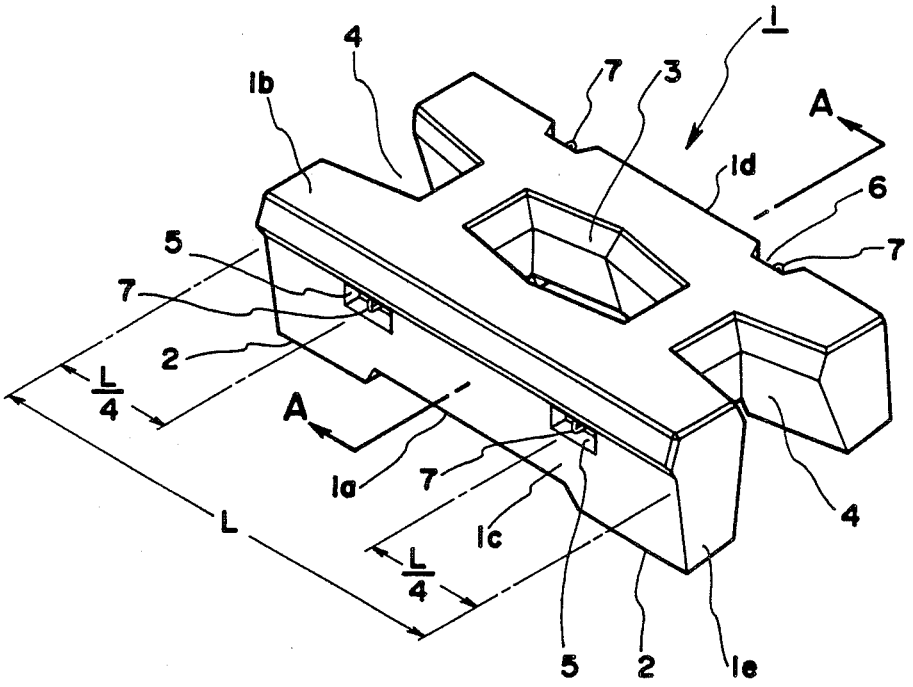
FIG. 1 is a perspective view of a block according to one embodiment of the present invention.
Figure 2:
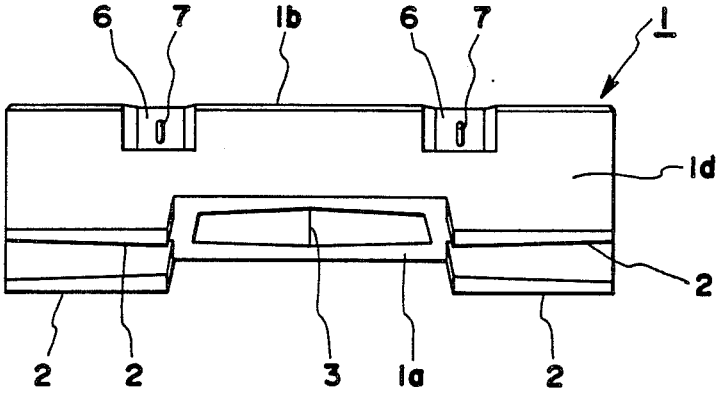
FIG. 2 is a rear view thereof.
Figure 3:
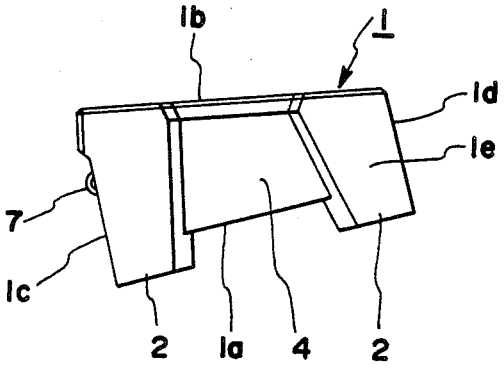
FIG. 3 is a side view thereof.
Figure 4:
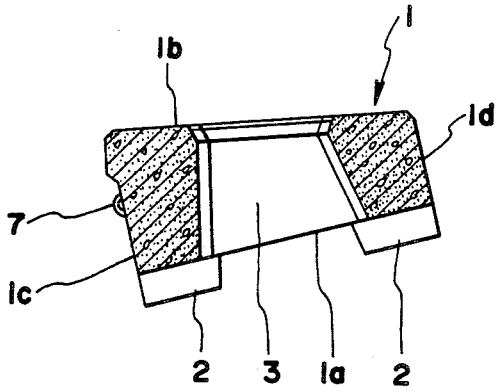
FIG. 4 is a sectional view taken on line A—A of FIG. 1.

A block member designated by reference numeral 1 is formed is a square shape. 1*a* denotes an under-surface of the block member 1 which is gradually inclined upwardly as it goes from a front surface portion 1*c* to a rear surface portion 1*d*. The under-surface 1*a* is provided at its four corners with leg members 2 having a generally same height. The block member 1 is formed at its central portion of its upper-surface 1*b* all the way down to the under-surface 1*a* with a through hole 3. Further, the block member 1 is formed at its both left and right side portions 1*e* with a concave groove 4 having a generally half dimension as that of the the through hole 3. Furthermore, the block member 1 is formed at its front surface portion 1*c* with a recess 5 at a place spaced apart from both the side portions 1*e*. More specifically, as shown in FIG. 1, if the length of the block member 1 is designated by L, the recess 5 is formed at a place spaced apart by L/4 from both the side portions 1*e* of the block member 1. In addition, the block member 1 is formed at its rear surface portion 1d side all the way up to the upper surface 1*d* with a recess 6 corresponding to the recess 5. The block member 1 is provided with two iron reinforcing bars 7 buried therein, with the through hole 3 therebetween, both ends of the iron reinforcing bars 7 projecting within the recesses 5 and 6 respectively. In the embodiment shown in FIG. 1, both end faces of the iron bars 7 are formed in an circular shape.

Next, there will be described how the block for a revetment described above is laid on the slope at the seashore and the like.

Figure 5:
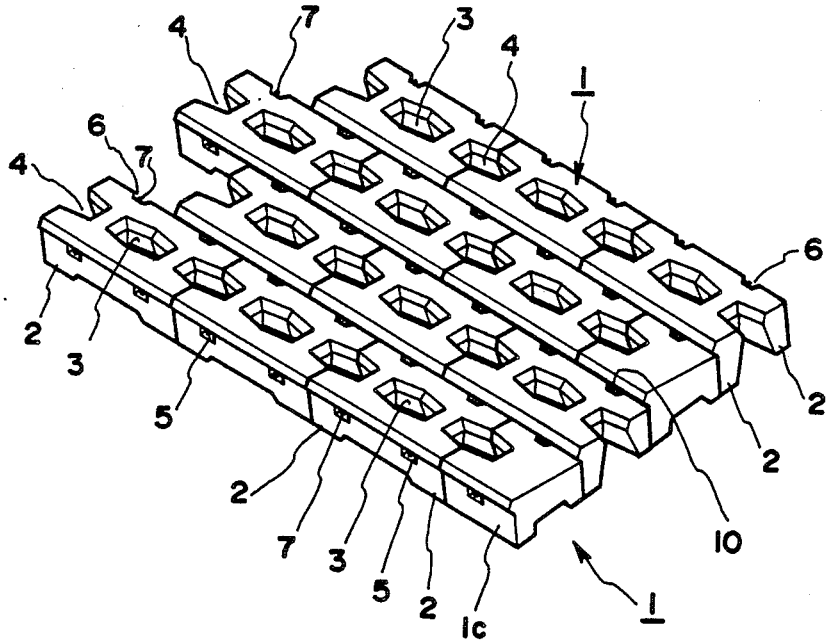
FIG. 5 is a perspective view for showing how the blocks are laid.
Figure 6:
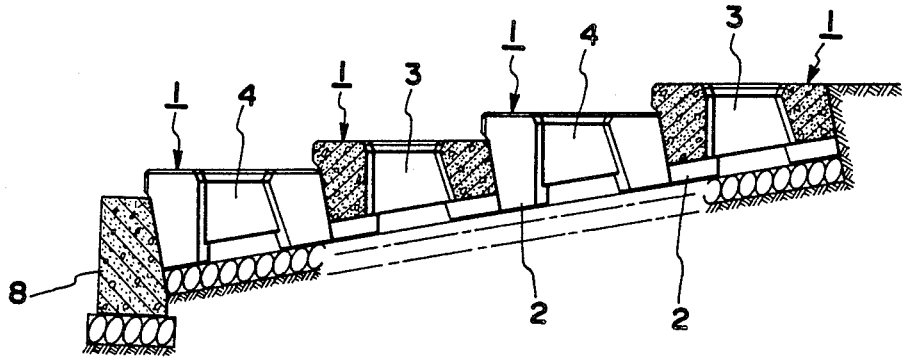
FIG. 6 is a side sectional view for showing how the blocks are laid on the slope.
Figure 7:
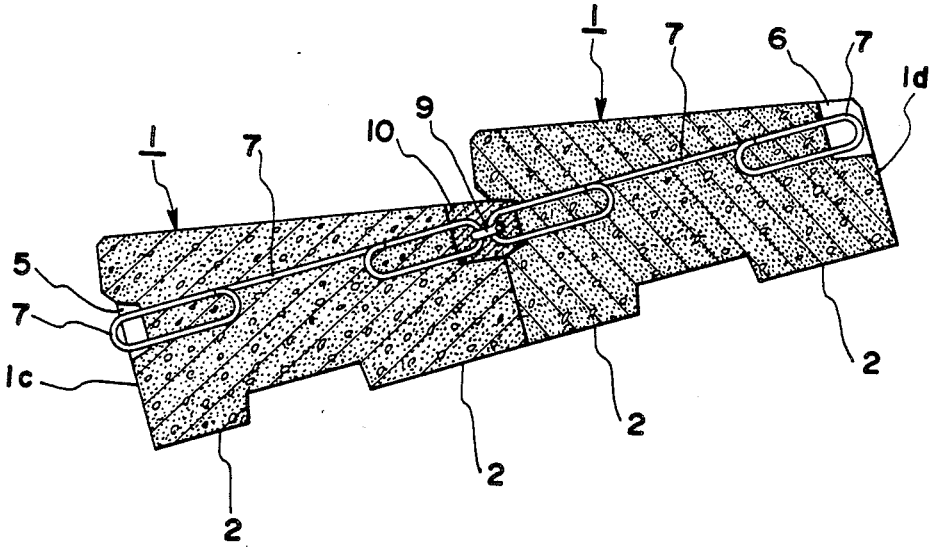
FIG. 7 is a side sectional view for showing how the blocks are connected one another.

In FIGS. 5 through 7, the front surface portion 1*c* of the block member 1 is abutted against a foundation 8. At the same time, the side surfaces of the respective block members 1 are abutted. In this way, a plurality of block members 1 are laid in parallel relation to form a first tier structure. Then, the block of a second tier structure is laid in such a manner as to astride over the rear surface portions 1*d* of two blocks of the first tier structure and to be abutted at the front surface portion 1*c* with the rear surface portions 1*d* of two blocks of the first tier structure. At the same time, the side surfaces of the block members 1 of the second tier structure are abutted against the side surfaces. In this way, the block members 1 are laid one after another upwardly to form a tier construction. After the iron reinforcing bars 7 projecting within the facing recesses 5 and 6 formed on the upper and lower tier block members 1 are connected, a concrete 10 is charged into the recesses 5 and 6. Then, a filling material such as concrete, sand, cobble stone is filled into a through hole formed by the concave recesses 4, 4 of adjacent block members 1 and into a through hole 3 of the block member 1. As is shown in FIG. 7, if both end faces of the iron reinforcing bars 7 are formed in a circular shape, the iron reinforcing bars 7 are connected by a shackle 9. On the other hand, if the end portions of the iron reinforcing bars are merely projected, they are connected by welding.

As apparent from the foregoing description, since all blocks are connected by iron reinforcing bars, they are integrally formed to construct a rigid revetment. In this way, the slope at the seashores and the like can be effectively covered with the block and the sucking of ballast can be perfectly prevented. Moreover, since the end portions of the iron reinforcing bar are projected within the recesses 5 and 6, the connection work is easy to perform. Furthermore, since the end portions of the iron reinforcing bars 7 are buried in the concrete 10 filled into the recesses 5 and 6, they are not corroded and can be to a relatively long time use. In addition, since the filling material is filled inside the through hole formed by the recess grooves formed by the through hole 3 and adjacent block members, when, for example, sand and pebble contained-waves beat upon the slope of the seashore, the sea water penetrates downward through the filling material of the through hole and is weakened its wave power, whereas when the wave is retreated, the sands and pebbles are left on the surfaces of the blocks. As a result, a sandy beach is formed on the revetment and the sheashore erosion or washing-out can be prevented. In addition, the filling material filled in the through hole is capable of preventing the blocks from being slipped out due to the dynamic lift of the wave. Thus, the object of the present invention as a revetment can be achieved.

If the through hole 3 and recess groove 4 are formed in such a manner as to be spread wider as it goes downward just like a trumpet, the filling material becomes more difficult to be slipped out by the wave power. Thus, the effect as a revetment is enhanced.

In this disclosure, there is shown and described only the preferred embodiment of the present invention, but it is to be understood that the present invention is capable of use in various other combinations and environment and is capable of changes or modifications within the scope of the inventive concept as expressed herein.

What is claimed is:

1. A block for a revetment comprising a square-shaped block member having upper, lower, front, rear, left and right side surfaces, said lower surface being slanted from said front surface to said rear surface, leg members having the same height and provided at four corner portions of said slanted lower-surface of said block member, said block defining a centrally positioned through hole extending from a central portion of said upper-surface of said block member all the way down to a central portion of said lower-surface thereof, said block defining concave groove means having a generally half dimension as that of said through hole and formed on both left and right side surfaces of said block member, recess means formed on both front and rear surfaces at locations spaced apart by $\frac{1}{4}$ of the length of said block member from the left and right side surfaces respectively and iron reinforcing bars buried in said block member and projecting within said recess means.

2. A block for a revetment as claimed in claim 1, wherein said recess means formed on said rear surface is formed on the rear surface and the upper surface.

* * * * *